US007851055B2

(12) United States Patent
Fukushima

(10) Patent No.: US 7,851,055 B2
(45) Date of Patent: Dec. 14, 2010

(54) HIGH-THERMAL-CONDUCTIVITY GRAPHITE-PARTICLES-DISPERSED-COMPOSITE AND ITS PRODUCTION METHOD

(75) Inventor: Hideko Fukushima, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 354 days.

(21) Appl. No.: 11/909,944

(22) PCT Filed: Oct. 25, 2005

(86) PCT No.: PCT/JP2005/019622

§ 371 (c)(1),
(2), (4) Date: Sep. 27, 2007

(87) PCT Pub. No.: WO2006/103798

PCT Pub. Date: Oct. 5, 2006

(65) Prior Publication Data

US 2009/0035562 A1 Feb. 5, 2009

(30) Foreign Application Priority Data

Mar. 29, 2005 (JP) ..... 2005-094876

(51) Int. Cl.
*B32B 17/02* (2006.01)
*B05D 3/02* (2006.01)
*B05D 3/12* (2006.01)

(52) U.S. Cl. ..... 428/293.1; 427/314; 427/383.1; 427/383.3; 428/328; 428/408; 428/409; 428/689

(58) Field of Classification Search ..... 427/314, 427/383.1, 383.3; 428/293.1, 328, 408, 409, 428/689
See application file for complete search history.

(56) References Cited

U.S. PATENT DOCUMENTS

| | | | | |
|---|---|---|---|---|
| 6,649,265 | B1 * | 11/2003 | Kawamura et al. | 428/408 |
| 7,282,265 | B2 * | 10/2007 | Fukushima | 428/408 |
| 7,563,502 | B2 * | 7/2009 | Tsushima et al. | 428/297.4 |
| 7,708,050 | B2 * | 5/2010 | Fukushima | 164/97 |
| 2004/0241447 | A1 * | 12/2004 | Fukushima | 428/408 |

FOREIGN PATENT DOCUMENTS

| | | | |
|---|---|---|---|
| EP | 1 055 650 | A1 | 11/2000 |
| JP | 57-185942 | | 11/1982 |
| JP | 58-144440 | | 8/1983 |
| JP | 10-298772 | | 11/1998 |
| JP | 2000-203973 | A | 7/2000 |
| JP | 2001-058255 | * | 3/2001 |
| JP | 2005-002470 | A | 1/2005 |

* cited by examiner

*Primary Examiner*—H. (Holly) T Le
(74) *Attorney, Agent, or Firm*—Sughrue Mion, PLLC

(57) ABSTRACT

A graphite-particles-dispersed composite produced by compacting graphite particles coated with a high-thermal-conductivity metal such as silver, copper and aluminum, the graphite particles having an average particle size of 20-500 μm, the volume ratio of the graphite particles to the metal being 60/40-95/5, and the composite having thermal conductivity of 150 W/mK or more in at least one direction.

17 Claims, 6 Drawing Sheets

HIGH-THERMAL-CONDUCTIVITY GRAPHITE-PARTICLES-DISPERSED-COMPOSITE AND ITS PRODUCTION METHOD

FIELD OF THE INVENTION

The present invention relates to a high-thermal-conductivity graphite/metal composite, particularly to a high-thermal-conductivity graphite-particles-dispersed composite produced by compacting graphite particles coated with a high-thermal-conductivity metal, and its production method.

BACKGROUND OF THE INVENTION

It is known that graphite is a high-thermal-conductivity material, but it is difficult to compacting only graphite. Thus proposed are graphite-particle-dispersed composites comprising such metals as copper, aluminum, etc. as binders. However, because graphite and metals do not have good wettability, there are too many boundaries of graphite particles in contact with each other when graphite particles exceed 50% by volume in the powder metallurgy method of producing composites from mixtures of graphite particles and metal powder, failing to obtain dense, high-thermal-conductivity composites.

To obtain dense, high-thermal-conductivity composites, attempts have been vigorously conducted to improve the wettability of graphite with metals. For instance, JP2002-59257 A discloses a composite material comprising gas-phase-grown carbon fibers having high thermal conductivity and a metal, the carbon fibers being coated with a silicon dioxide layer to have improved wettability to the metal. However, because carbon fibers are used, it suffers high production cost. And because a silicon dioxide layer having as low thermal conductivity as 10 W/mK is formed on the carbon fibers, the resultant composite fails to have sufficiently high thermal conductivity.

JP2001-339022 A discloses a method for producing a heat sink material comprising firing carbon or its allotrope (graphite, etc.) to form a porous sintered body, impregnating the porous sintered body with a metal, and cooling the resultant metal-impregnated, porous sintered body, the metal containing a low-melting-point metal (Te, Bi, Pb, Sn, etc.) for improving wettability in their boundaries, and a metal (Nb, Cr, Zr, Ti, etc.) for improving reactivity with carbon or its allotrope. However, it suffers high production cost because a porous sintered body of carbon or its allotrope is impregnated with a metal, and there is high thermal resistance between carbon or its allotrope and the metal because the low-melting-point metal and the reactivity-improving metal are added. Further, the impregnating metal has reduced thermal conductivity because it contains the low-melting-point metal and the reactivity-improving metal, failing to achieve high thermal conductivity.

JP2000-247758 A discloses a thermally conductive body comprising carbon fibers and at least one metal selected from the group consisting of copper, aluminum, silver and gold to have thermal conductivity of at least 300 W/mK, the carbon fibers being plated with nickel. However, it suffers high production cost because carbon fibers are used, and high thermal conductivity cannot be expected despite the use of carbon fibers because the carbon fibers are plated with Ni having low thermal conductivity.

JP10-298772 A discloses a method for producing a conductive member comprising the steps of depositing 25-40% by weight of copper on carbonaceous powder in a primary particle state by electroless plating, pressing the resultant copper-coated carbonaceous powder, and sintering it. However, this conductive member is used for applications needing low electric resistance and low friction resistance such as current-feeding brushes, and this reference has no descriptions about thermal conductivity at all. The measurement of the thermal conductivity of this conductive member has revealed that it is much lower than 150 W/mK. This appears to be due to the fact that because artificial graphite powder used has as small an average particle size as 2-3 μm, there are many boundaries between graphite powders, failing to efficiently utilize high thermal conductivity of graphite.

OBJECTS OF THE INVENTION

Accordingly, an object of the present invention is to provide a graphite-particles-dispersed composite capable of effectively exhibiting high thermal conductivity owned by graphite, and its production method.

DISCLOSURE OF THE INVENTION

As a result of research in view of the above object, it has been found that a high-thermal-conductivity graphite/metal composite, in which high thermal conductivity owned by graphite is efficiently utilized, can be obtained by coating relatively large graphite particles with a high-thermal-conductivity metal and then pressing them in at least one direction. The present invention has been completed based on such finding.

Thus, the graphite-particles-dispersed composite of the present invention is produced by compacting graphite particles coated with a high-thermal-conductivity metal, the graphite particles having an average particle size of 20-500 μm, the volume ratio of the graphite particles to the metal being 60/40-95/5, and the composite having thermal conductivity of 150 W/mK or more in at least one direction.

In a preferred embodiment of the present invention, the composite has a structure that the metal-coated graphite particles are pressed in one direction so that the graphite particles and the metal are laminated in the pressing direction. The graphite particles preferably have a (002) interplanar distance of 0.335-0.337 nm.

The graphite particles are preferably at least one selected from the group consisting of pyrolytic graphite, Kish graphite and natural graphite, particularly preferably Kish graphite. The metal is preferably at least one selected from the group consisting of silver, copper and aluminum. The graphite particles preferably have an average particle size of 40-400 μm, and an average aspect ratio of 2 or more.

The relative density of the graphite-particles-dispersed composite of the present invention is preferably 80% or more, more preferably 90% or more, most preferably 92% or more.

The method of the present invention for producing a graphite-particles-dispersed composite having thermal conductivity of 150 W/mK or more in at least one direction comprises the steps of coating 60-95% by volume of graphite particles having an average particle size of 20-500 μm with 40-5% by volume of a high-thermal-conductivity metal, and pressing the resultant metal-coated graphite particles in at least one direction for compaction.

Used as the graphite particles are preferably at least one selected from the group consisting of pyrolytic graphite particles, Kish graphite particles and natural graphite particles, particularly preferably Kish graphite particles. Used as the metal is preferably at least one selected from the group consisting of silver, copper and aluminum, particularly preferably copper. The graphite particles preferably have an average particle size of 40-400 μm, and an average aspect ratio of 2 or more.

The compacting of the metal-coated graphite particles is preferably conducted by at least one of a uniaxial pressing method, a cold-isostatic-pressing method, a rolling method, a hot-pressing method, a pulsed-current pressure sintering method and a hot-isostatic-pressing method.

The metal-coated graphite particles are preferably uniaxially pressed, and then heat-treated at a temperature of 300° C. or higher and lower than the melting point of the metal. When the metal is copper, the heat treatment temperature is more preferably 300-900° C., most preferably 500-800° C. The pressing is preferably conducted at a pressure of 20-200 MPa during the heat treatment.

The graphite particles are coated with the metal preferably by an electroless plating method or a mechanical alloying method.

The method for producing a graphite-particles-dispersed composite having thermal conductivity of 150 W/mK or more in at least one direction according to a particularly preferred embodiment of the present invention comprises the steps of electroless-plating 60-95% by volume of graphite particles, which are at least one selected from the group consisting of pyrolytic graphite, Kish graphite and natural graphite and have an average particle size of 20-500 μm, with 40-5% by volume of copper; pressing the resultant copper-plated graphite particles in one direction at room temperature; and then heat-treating it at 300-900° C. The pressing is preferably conducted at a pressure of 20-200 MPa during the heat treatment.

BRIEF DESCRIPTION OF THE DRAWINGS

FIG. 3(*b*) is an electron photomicrograph (magnification: 400 times) showing the cross section structure in the pressing direction of the composite of Example 3.

FIG. 5(*b*) is an electron photomicrograph (magnification: 2,000 times) showing the cross section structure in the pressing direction of the composite heat-treated at 700° C. in Example 22.

FIG. 5(*c*) is an electron photomicrograph (magnification: 10,000 times) showing the cross section structure in the pressing direction of the composite heat-treated at 700° C. in Example 22.

FIG. 5(*d*) is an electron photomicrograph (magnification: 50,000 times) showing the cross section structure in the pressing direction of the composite heat-treated at 700° C. in Example 22.

DESCRIPTION OF THE BEST MODE OF THE INVENTION

[1] Graphite-Particles-Dispersed Composite (A) Graphite Particles

The graphite particles are preferably pyrolytic graphite, Kish graphite or natural graphite. The pyrolytic graphite is a polycrystalline body composed of micron-order crystal particles, but it shows properties close to those of single-crystal graphite because the c-axes of their crystal particles are aligned in the same direction. Accordingly, ideal graphite particles have thermal conductivity close to about 2000 W/mK in a- and b-axes. Also, because the pyrolytic graphite, the Kish graphite and the natural graphite have structures close to that of ideal graphite, in which microcrystals are oriented in a particular direction, they have high thermal conductivity. Specifically, the pyrolytic graphite has thermal conductivity of about 1000 W/mK, the Kish graphite has thermal conductivity of about 600 W/mK, and the natural graphite has thermal conductivity of about 400 W/mK.

The average particle size of the graphite particles used in the present invention is 20-500 μm, preferably 40-400 μm. Because graphite is not wetted with a metal, the graphite particles are preferably as large as possible to avoid high thermal resistance in boundaries between graphite and metal. However, because the graphite particles per se have limited deformability, the use of too large graphite particles leaves gaps between the graphite particles after compacted, rather failing to achieve high density and thermal conductivity. Accordingly, the lower limit of the average particle size of the graphite particles is 20 μm, preferably 40 μm. The upper limit of the average particle size of the graphite particles is 500 μm, preferably 400 μm. The average particle size of the graphite particles can be measured by a laser-diffraction-type particle size distribution meter.

Figure 1:
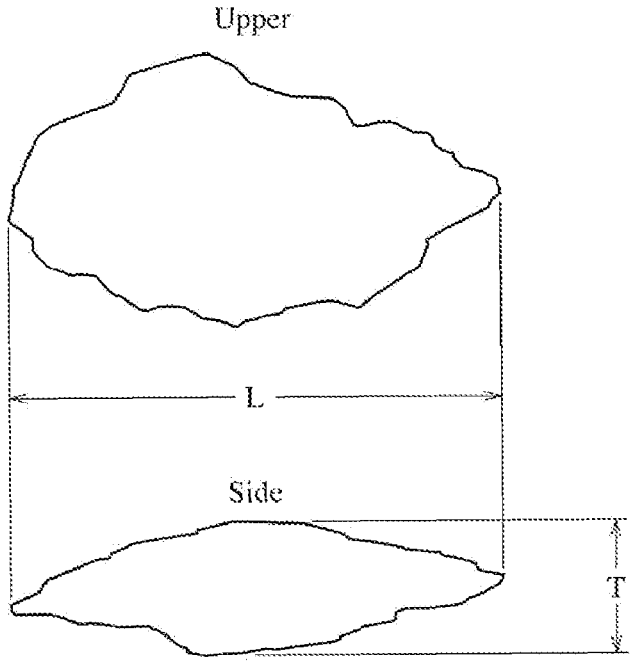
FIG. 1 is a schematic view showing a method for determining the aspect ratio of typical graphite particles.

Because the graphite particles are generally flat, they are arranged in layer when formed into the composite. The more laminar the graphite particle arrangement, the less decrease in the thermal conductivity of graphite per se. Thus, the shapes of the graphite particles are important. Because typical graphite particles have flat, irregular shapes as shown in, for instance, FIG. 1, their shapes are preferably expressed by an aspect ratio. In the present invention, the aspect ratio of each graphite particle is expressed by a ratio L/T, wherein L represents the length of a long axis, and T represents the length of a short axis (thickness). The average aspect ratio is preferably 2 or more, more preferably 2.5 or more, most preferably 3 or more.

The graphite particles preferably have a (002) interplanar distance of 0.335-0.337 nm. When the (002) interplanar distance is less than 0.335 nm or more than 0.337 nm, graphite per se has low thermal conductivity because of a low degree of crystallization, resulting in difficulty in obtaining a graphite-particles-dispersed composite having thermal conductivity of 150 W/mK or more in at least one direction.

(B) Coating Metal

The metal covering the graphite particles should have as high thermal conductivity as possible. Accordingly, it is preferably at least one selected from the group consisting of silver, copper and aluminum. Among them, copper is preferable because of high thermal conductivity, excellent oxidation resistance and inexpensiveness.

(C) Volume Ratio

When the volume ratio of the graphite particles has is less than 60%, high thermal conductivity of graphite is not fully exhibited, failing to achieve thermal conductivity of 150

W/mK or more in at least one direction. When the volume ratio of the graphite particles is more than 95%, too little metal layer exists between the graphite particles, resulting in difficulty in the densification of the composite, and thus failing to achieve thermal conductivity of 150 W/mK or more in at least one direction. The preferred volume ratio of the graphite particles is 70-90%.

(D) Thermal Conductivity

Figure 3A:
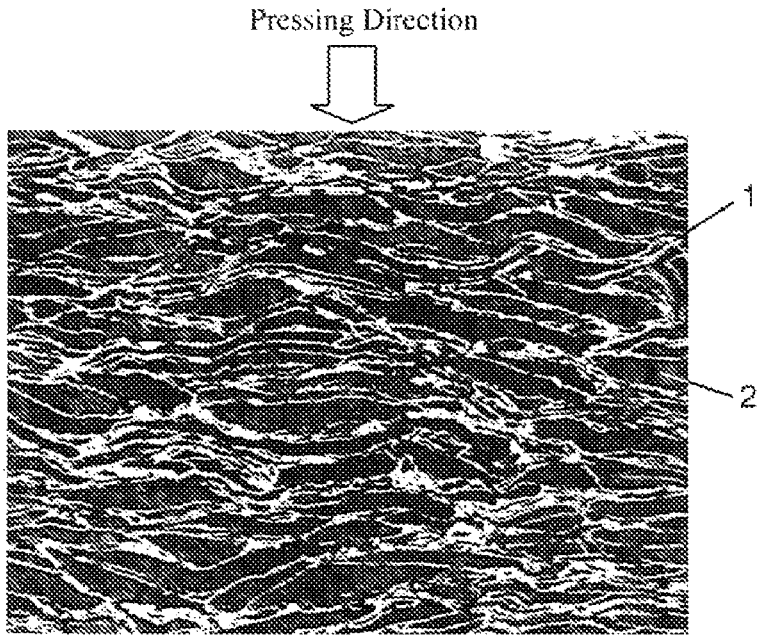
FIG. 3(*a*) is an electron photomicrograph (magnification: 100 times) showing the cross section structure in the pressing direction of the composite of Example 3.
Figure 3B:
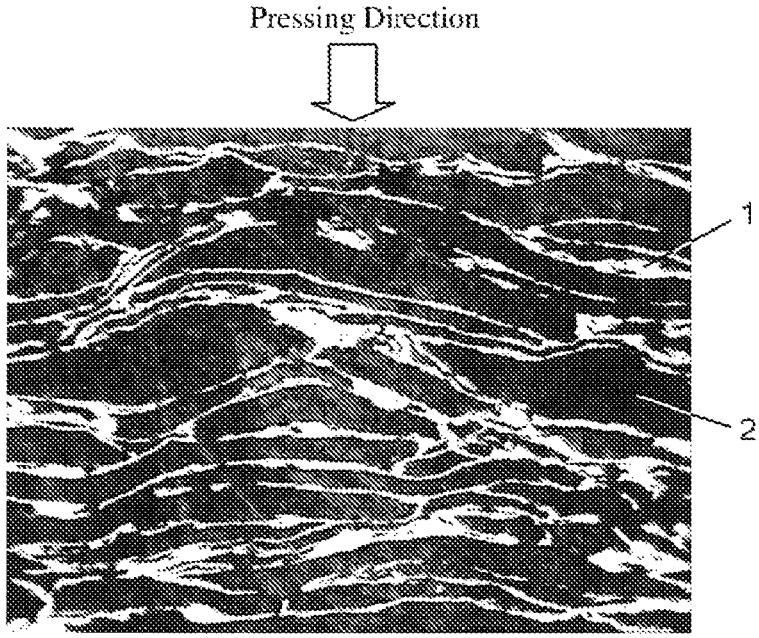

The thermal conductivity of the graphite-particles-dispersed composite of the present invention has anisotropy, extremely large in a direction perpendicular to the pressing direction and small in the pressing direction. This is due to the fact that the graphite particles used are flat, that the graphite and the metal are arranged in layers in the pressing direction as shown in FIG. 3, and that the thermal conductivity of the graphite particles is higher in their long axis directions than in their short axis directions. For instance, Kish graphite per se has as large thermal conductivity as about 600 W/mK. Accordingly, if decrease of thermal conductivity in the boundaries between the graphite particles and the metal were prevented as much as possible, it would be expected to provide the resultant composite with extremely high thermal conductivity close to about 600 W/mK. Accordingly, conditions such as the average particle size of the graphite particles, the relative density of the composite, the heat treatment, etc. are optimized. As a result, the thermal conductivity of the graphite-particles-dispersed composite of the present invention is 150 W/mK or more, preferably 200 W/mK or more, most preferably 300 W/mK or more, in at least one direction.

(E) Relative Density

As described above, to achieve high thermal conductivity, the relative density of the composite is preferably 80% or more, more preferably 90% or more, most preferably 92% or more. What is most important to obtain a high relative density is the average particle size of the graphite particles, and the heat treatment temperature and the type and aspect ratio of the graphite particles are also important. As described above, to obtain a high relative density, the average particle size of the graphite particles has a lower limit of 20 μm, preferably 40 μm, and an upper limit of 500 μm, preferably 400 μm. The heat treatment temperature is, as described below, 300° C. or higher, preferably 300-900° C., more preferably 500-800° C. Further, when the pressing is conducted at 20 MPa or more during the heat treatment, the composite has a higher relative density.

(F) Other Properties (1) Peak Ratio of Metal in X-Ray Diffraction

By determining a ratio of a second peak value to a first peak value (simply called "peak ratio") from the X-ray diffraction of a metal portion in the composite, it is possible to judge whether the metal has high thermal conductivity or not. The first peak value is the intensity of the highest peak, and the second peak value is the intensity of the second-highest peak. The thermal conductivity of the coating metal is judged from the peak ratio by the following standard.

(a) When Coating Metal is Copper

A 1-mm-thick, rolled copper plate (oxygen-free copper C1020P, available from Furukawa Electric Co., Ltd.) is cut to 7 mm×7 mm, and subjected to a heat treatment comprising heating it at a speed of 300° C./hr in vacuum, keeping it at 900° C. for 1 hour, and cooling it in a furnace, to obtain a copper reference plate. The copper reference plate has a peak ratio of 46%. As the peak ratio of the graphite/copper composite nears 46%, the inherent properties of copper are more exhibited, resulting in providing the composite with higher thermal conductivity.

(b) When Coating Metal is Aluminum

A reference plate is produced by pressing aluminum powder (purity: 4N, available from Yamaishi Metals Co., Ltd.) to a size of 7 mm×7 mm×1 mm at a pressure of 500 MPa, and subjecting it to a heat treatment comprising heating it at a speed of 300° C./hr in vacuum, keeping it at 550° C. for 1 hour, and cooling it in a furnace. This aluminum reference plate has a peak ratio of 40%.

(c) When Coating Metal is Silver

A reference plate is produced by pressing silver powder (purity: 4N, available from Dowa Metals & Mining Co., Ltd.) to a size of 7 mm×7 mm×1 mm at a pressure of 500 MPa, and subjecting it to a heat treatment comprising heating it at a speed of 300° C./hr in vacuum, keeping it at 900° C. for 1 hour, and cooling it in a furnace. This silver reference plate has a peak ratio of 47%.

(2) Half-Width of Metal in X-Ray Diffraction

The half-width of the metal can be determined from the X-ray diffraction of the metal portion in the composite. The half-width represents the width of the first peak. The half-width of the metal is proportional to the degree of crystallization of the metal. The higher degree of crystallization a metal has, the higher thermal conductivity the composite has. For instance, when the coating metal is copper, the half-width of copper in the composite is preferably 4 times or less, assuming that the first peak of the copper reference plate has a half-width of 1.

(3) Oxygen Concentration in Metal

The lower oxygen concentration the metal portion in the composite has, the higher thermal conductivity the metal portion has, resulting in higher thermal conductivity of the composite. Accordingly, the oxygen concentration of the metal portion is preferably 20000 ppm or less.

[2] Production Method of Graphite-Particles-Dispersed Composite (A) Metal Coating Generally used metal-coating methods include an electroless plating method, a mechanical alloying method, a chemical vapor deposition (CVD) method, a physical vapor deposition (PVD) method, etc., but it is extremely difficult to form a metal coating of uniform thickness on large amounts of graphite particles by the CVD or PVD method. To form a metal coating of uniform thickness on large amounts of graphite particles, an electroless plating method and a mechanical alloying method are preferable, particularly the electroless plating method is more preferable. The electroless plating method and the mechanical alloying method may be conducted alone or in combination. Although the mechanical alloying method generally produces alloy powder without melting by using such an apparatus as a ball mill, etc., it forms a metal coating by adhering metal to the graphite particle surface without forming an alloy of a metal and graphite in the present invention.

Because the metal coating formed by the electroless plating method or the mechanical alloying method firmly adheres to the graphite particle surfaces, thermal resistance is small in the boundaries between the graphite particles and the metal coating. Accordingly, the graphite-particles-dispersed composite having high thermal conductivity is obtained by compacting the metal-coated graphite particles.

(B) Compacting

The metal-coated graphite particles are compacted by pressing in at least one direction. The pressing plastically deforms the metal coating covering the graphite particles to fill gaps between the graphite particles. Specifically, the compacting of the metal-coated graphite particles is preferably conducted by a uniaxial pressing method, a cold-isostatic-pressing method (CIP) method, a hot-pressing (HP) method, a pulsed-current pressure sintering (SPS) method, a hot-isostatic-pressing (HIP) method, or a rolling method.

By the uniaxial pressing method and the CIP method at room temperature, the unheated metal coating is unlikely to be plastically deformed. Accordingly, the pressing pressure is preferably as high as possible. Accordingly, in the case of the uniaxial pressing method and the CIP method at room temperature, pressure applied to the metal-coated graphite particles is preferably 100 MPa or more, more preferably 500 MPa or more.

In the case of the HP method and the SPS method, the pressing pressure is preferably 10 MPa or more, more preferably 50 MPa or more. In the case of the HIP method, the pressing pressure is preferably 50 MPa or more, more preferably 100 MPa or more. In any method, the lower limit of the heating temperature is preferably a temperature at which the metal coating is easily plastically deformed. Specifically, it is preferably 400° C. or higher for silver, 500° C. or higher for copper, and 300° C. or higher for Al. The upper limit of the heating temperature is preferably lower than the melting point of the metal coating. When the heating temperature is equal to or higher than the melting point of the metal, the metal is melted to detach from the graphite particles, failing to obtain the graphite-particles-dispersed composite in which graphite particles are uniformly dispersed.

In the case of the HP method, the pulsed-current pressing method and the HIP method, the atmosphere is preferably non-oxidative to prevent the oxidation of the metal coating, which leads to low thermal conductivity. The non-oxidizing atmosphere includes, vacuum, a nitrogen gas, an argon gas, etc.

(C) Heat Treatment

The compacted composite is preferably heat-treated at a temperature of 300° C. or higher and lower than the melting point of the metal. When the heat treatment temperature is lower than 300° C., there is substantially no effect of removing residual stress from the graphite-particles-dispersed composite. When the heat treatment temperature reaches the melting point of the metal or higher, the metal separates from graphite, failing to obtain a dense composite. When heat-treated at a temperature close to the melting point of the metal, residual stress is effectively removed from the composite. In the heat treatment, a temperature-elevating speed is preferably 30° C./minute or less, and a temperature-lowering speed is preferably 20° C./minute or less. A preferred example of the temperature-elevating speed and the temperature-lowering speed is 10° C./minute. When the temperature-elevating speed is more than 30° C./minute, or when the temperature-lowering speed is more than 20° C., residual stress is newly generated by rapid heating or cooling. When pressed during the heat treatment, the density and thermal conductivity of the composite are further improved. The pressing pressure during the heat treatment is preferably 20-200 MPa, more preferably 50-100 MPa.

Because the graphite-particles-dispersed composite of the present invention is produced by pressing and compacting the metal-coated graphite particles, even those in which the graphite percentage exceeds 50% by volume have a dense structure. In addition, because the graphite-dispersed composite has a laminar structure composed of graphite and a metal in the pressing direction, it has high thermal conductivity in a direction perpendicular to the pressing direction.

The present invention will be explained in more detail by Examples below, without intention of restricting the present invention thereto.

The following items in each Example and Comparative Example were measured by the following methods.

(1) Average Particle Size

Measured after ultrasonic dispersion in ethanol for 3 minutes using a laser-diffraction-type particle size distribution meter (LA-920) available from Horiba, Ltd.

(2) Average Aspect Ratio

A ratio L/T determined from the image analysis of a photomicrograph, wherein L and T were the long axis and short axis of each graphite particle, respectively, was averaged.

(3) Interplanar Distance of (002)

Measured using an X-ray diffraction apparatus (RINT2500) of Rigaku.

(4) Thermal Conductivity

Measured according to JIS R 1611, using a thermal properties-measuring apparatus (LFA-502) by a laser flash method available from Kyoto Electronics Manufacturing Co., Ltd.

(5) Relative Density

The densities of the metal-coated graphite particles and the graphite/metal composite were measured to determine their relative densities by [(density of graphite/metal composite)/(density of metal-coated graphite particles)]×100%.

(6) Peak Value and Half-Width of X-Ray Diffraction of Copper Portion in Composite Measured using an X-ray diffraction apparatus (RINT2500) of Rigaku.

Example 1

80% by volume of Kish graphite having an average particle size of 91.5 μm and an average aspect ratio of 3.4 was electroless-plated with 20% by volume of silver. The resultant silver-coated graphite particles were uniaxially pressed at 500 MPa and room temperature for 1 minute, to obtain a graphite/silver composite. No heat treatment was conducted to this graphite/silver composite. Measurement showed that the graphite/silver composite had thermal conductivity of 180 W/mK in a direction perpendicular to the pressing direction.

Example 2

85% by volume of Kish graphite having an average particle size of 91.5 μm, a (002) interplanar distance of 0.3355 and an average aspect ratio of 3.4 was electroless-plated with 15% by volume of copper. The resultant copper-coated graphite particles were uniaxially pressed at 1000 MPa and room temperature for 1 minute, to obtain a graphite/copper composite. This graphite/copper composite was heat-treated at 600° C., in vacuum for 1 hour. Measurement showed that the graphite/copper composite had thermal conductivity of 280 W/mK in a direction perpendicular to the pressing direction.

Example 3

Figure 2:
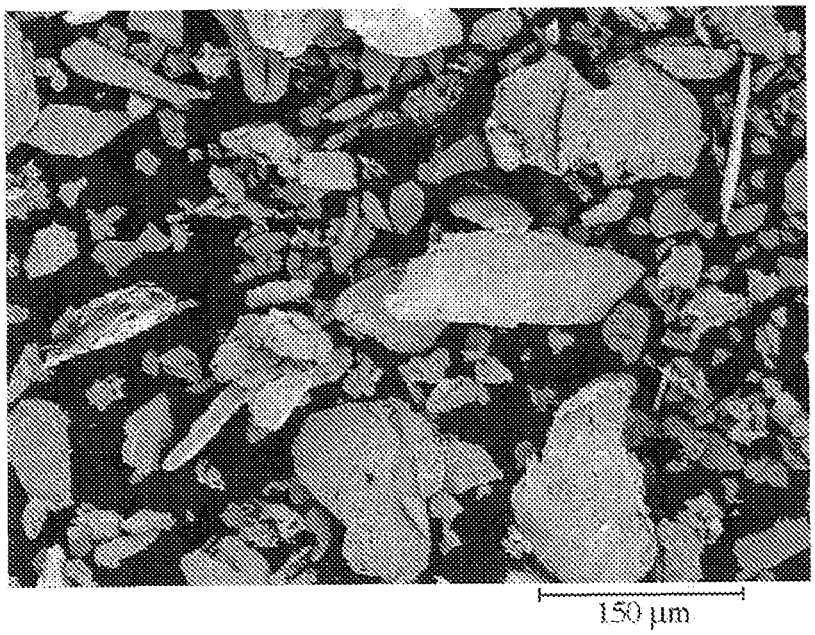
FIG. 2 is an electron photomicrograph showing the graphite particles used in Example 3.

85% by volume of Kish graphite having an average particle size of 91.5 μm and an average aspect ratio of 3.4 was electroless-plated with 15% by volume of copper. FIG. 2 is a photomicrograph of the resultant copper-coated graphite particles. The copper-coated graphite particles were sintered under the conditions of 60 MPa and 1000° C. for 10 minutes by a pulsed-current pressure sintering (SPS) method, to obtain a graphite/copper composite. This graphite/copper composite was not heat-treated. Measurement showed that the graphite/copper composite had thermal conductivity of 420 W/mK in a direction perpendicular to the pressing direction. FIGS. 3(*a*) and 3(*b*) are electron photomicrographs of the cross section of the graphite/copper composite in a pressing direction. In the figures, 1 shows a copper layer, and 2 shows a graphite phase. As shown in FIGS. 3(*a*) and 3(*b*), this graphite/copper composite is formed by bonding composite particles comprising planar graphite particles surrounded by copper, and has a dense laminar structure whose lamination direction is in alignment with the pressing direction. Accordingly, this composite has high thermal conductivity in a direction perpendicular to the pressing direction. This is true of the graphite/metal composite of the present invention other than the graphite/copper composite.

Example 4

80% by volume of Kish graphite having an average particle size of 91.5 μm, a (002) interplanar distance of 0.3358 and an average aspect ratio of 3.4 was electroless-plated with 20% by volume of copper. The resultant copper-coated graphite particles were sintered at 60 MPa and 900° C. for 60 minutes by a hot-pressing (HP) method, to obtain a graphite/copper composite. This graphite/copper composite was heat-treated at 900° C. in vacuum for 1 hour. Measurement showed that the graphite/copper composite had thermal conductivity of 420 W/mK in a direction perpendicular to the pressing direction.

Example 5

90% by volume of Kish graphite having an average particle size of 91.5 μm, a (002) interplanar distance of 0.3358 and an average aspect ratio of 3.4 was electroless-plated with 10% by volume of aluminum. The resultant aluminum-coated graphite particles were sintered 60 MPa and 550° C. for 10 minutes by an SPS method, to obtain a graphite/aluminum composite. This graphite/aluminum composite was heat-treated at 500° C. in air at atmospheric pressure for 1 hour. Measurement showed that the graphite/aluminum composite had thermal conductivity of 300 W/mK in a direction perpendicular to the pressing direction.

Example 6

70% by volume of pyrolytic graphite having an average particle size of 86.5 μm, a (002) interplanar distance of 0.3355 and an average aspect ratio of 5.6 was coated with 30% by volume of silver by a mechanical alloying method. The resultant silver-coated graphite particles were sintered at 80 MPa and 1000° C. for 60 minutes by a HP method, to obtain a graphite/silver composite. This graphite/silver composite was heat-treated at 900° C. in vacuum for 1 hour. Measurement showed that the graphite/silver composite had thermal conductivity of 320 W/mK in a direction perpendicular to the pressing direction.

Example 7

65% by volume of pyrolytic graphite having an average particle size of 86.5 μm, a (002) interplanar distance of 0.3355 and an average aspect ratio of 5.6 was coated with 35% by volume of copper by a mechanical alloying method. The resultant copper-coated graphite particles were uniaxially pressed at 500 MPa and room temperature for 1 minute, to obtain a graphite/copper composite. This graphite/copper composite was heat-treated at 700° C. in a nitrogen atmosphere at atmospheric pressure for 1 hour. Measurement showed that the graphite/copper composite had thermal conductivity of 300 W/mK in a direction perpendicular to the pressing direction.

Example 8

75% by volume of Kish graphite having an average particle size of 91.5 μm and an average aspect ratio of 3.4 was coated with 25% by volume of aluminum by a mechanical alloying method. The resultant aluminum-coated graphite particles were sintered at 1000 MPa and 500° C. for 60 minutes by a hot-isostatic pressing (HIP) method, to obtain a graphite/aluminum composite. This graphite/aluminum composite was not heat-treated. Measurement showed that the graphite/aluminum composite had thermal conductivity of 280 W/mK in a direction perpendicular to the pressing direction.

Example 9

85% by volume of Kish graphite having an average particle size of 91.5 μm, a (002) interplanar distance of 0.3355 and an average aspect ratio of 3.4 was electroless-plated with 15% by volume of copper. The resultant copper-coated graphite particles were uniaxially pressed at 1000 MPa and room temperature for 1 minute, to obtain a graphite/copper composite. This graphite/copper composite was heat-treated at 800° C. in an argon atmosphere at 100 MPa for 1 hour. Measurement showed that the graphite/copper composite had thermal conductivity of 440 W/mK in a direction perpendicular to the pressing direction.

Example 10

90% by volume of Kish graphite having an average particle size of 91.5 μm and an average aspect ratio of 3.4 was electroless-plated with 10% by volume of silver. The resultant silver-coated graphite particles were uniaxially pressed 500 MPa and room temperature for 1 minute, to obtain a graphite/silver composite. This graphite/silver composite was heat-treated at 700° C. in an argon atmosphere at 100 MPa for 1 hour. Measurement showed that the graphite/silver composite had thermal conductivity of 460 W/mK in a direction perpendicular to the pressing direction.

Example 11

90% by volume of Kish graphite having an average particle size of 91.5 μm and an average aspect ratio of 3.4 was electroless-plated with 10% by volume of copper. The resultant copper-coated graphite particles were uniaxially pressed at 1000 MPa and room temperature for 1 minute, to obtain a graphite/copper composite. This graphite/copper composite was not heat-treated. Measurement showed that graphite/copper composite had thermal conductivity of 220 W/mK in a direction perpendicular to the pressing direction.

Example 12

60% by volume of natural graphite having an average particle size of 98.3 μm, a (002) interplanar distance of 0.3356 and an average aspect ratio of 2.3 was electroless-plated with 40% by volume of copper. The resultant copper-coated graphite particles were uniaxially pressed at 500 MPa and room temperature for 1 minute, to obtain a graphite/copper composite. This graphite/copper composite was not heat-treated. Measurement showed that the graphite/copper composite had thermal conductivity of 150 W/mK in a direction perpendicular to the pressing direction.

Example 13

95% by volume of natural graphite having an average particle size of 98.3 μm, a (002) interplanar distance of 0.3356 and an average aspect ratio of 2.3 was electroless-plated with 5% by volume of copper. The resultant copper-coated graphite particles were uniaxially pressed at 500 MPa and room temperature for 1 minute, to obtain a graphite/copper composite. This graphite/copper composite was not heat-treated. Measurement showed that the graphite/copper composite had thermal conductivity of 250 W/mK in a direction perpendicular to the pressing direction.

Example 14

65% by volume of Kish graphite having an average particle size of 91.5 μm and an average aspect ratio of 3.4 was coated with 35% by volume of aluminum by a mechanical alloying method. The resultant aluminum-coated graphite particles were cold-rolled at 1000 MPa and room temperature, to obtain a graphite/aluminum composite. This graphite/aluminum composite was heat-treated at 500° C. in air at atmospheric pressure for 1 hour. Measurement showed that the graphite/aluminum composite had thermal conductivity of 200 W/mK in a direction perpendicular to the pressing direction.

Comparative Example 1

55% by volume of Kish graphite particles having an average particle size of 91.5 μm and an average aspect ratio of 3.4 were dry-mixed with 45% by volume of aluminum powder having an average particle size of 10 μm by a ball mill. The resultant mixed powder was uniaxially pressed at 500 MPa and room temperature for 1 minute, to obtain a graphite/aluminum composite. This graphite/aluminum composite was not heat-treated. Measurement showed that the graphite/aluminum composite had thermal conductivity of 120 W/mK in a direction perpendicular to the pressing direction.

Comparative Example 2

85% by volume of artificial graphite having an average particle size of 6.8 μm, a (002) interplanar distance of 0.3375 and an average aspect ratio of 1.6 was electroless-plated with 15% by volume of copper. The resultant copper-coated graphite particles were sintered at 60 MPa and 900° C. for 60 minutes by a HP method, to obtain a graphite/copper composite. This graphite/copper composite was not heat-treated. Measurement showed that the graphite/copper composite had thermal conductivity of 100 W/mK in a direction perpendicular to the pressing direction.

Comparative Example 3

70% by volume of artificial graphite having an average particle size of 6.8 μm, a (002) interplanar distance of 0.3378 and an average aspect ratio of 1.6 was coated with 30% by volume of silver by a mechanical alloying method. The resultant silver-coated graphite particles were sintered under the conditions of 50 MPa and 1000° C. for 10 minutes by an SPS method, to obtain a graphite/silver composite. This graphite/silver composite was not heat-treated. Measurement showed that the graphite/silver composite had thermal conductivity of 120 W/mK in a direction perpendicular to the pressing direction.

Comparative Example 4

85% by volume of Kish graphite having an average particle size of 91.5 μm and an average aspect ratio of 3.4 was dry-mixed with 15% by volume of copper powder having an average particle size of 5.6 μm by a ball mill. The resultant mixed powder was uniaxially pressed at 500 MPa and room temperature for 1 minute, to obtain a graphite/copper composite. This graphite/copper composite was not heat-treated. Measurement showed that the graphite/copper composite had thermal conductivity of 80 W/mK in a direction perpendicular to the pressing direction.

The production conditions and thermal conductivities of the composites of Examples 1-14 and Comparative Examples 1-4 are shown in Tables 1-3.

TABLE 1

| | Graphite Particles | | | | | Coating Metal | |
|---|---|---|---|---|---|---|---|
| No. | Type | Average Particle Size (μm) | Interplanar Distance (nm) | Average Aspect Ratio | Percentage (vol. %) | Type | Percentage (vol. %) |
| Example 1 | Kish Graphite | 91.5 | — | 3.4 | 80 | Ag | 20 |
| Example 2 | Kish Graphite | 91.5 | 0.3355 | 3.4 | 85 | Cu | 15 |
| Example 3 | Kish Graphite | 91.5 | — | 3.4 | 85 | Cu | 15 |
| Example 4 | Kish Graphite | 91.5 | 0.3358 | 3.4 | 80 | Cu | 20 |
| Example 5 | Kish Graphite | 91.5 | 0.3358 | 3.4 | 90 | Al | 10 |
| Example 6 | Pyrolytic Graphite | 86.5 | 0.3355 | 5.6 | 70 | Ag | 30 |
| Example 7 | Pyrolytic Graphite | 86.5 | 0.3355 | 5.6 | 65 | Cu | 35 |
| Example 8 | Kish Graphite | 91.5 | — | 3.4 | 75 | Al | 25 |
| Example 9 | Kish Graphite | 91.5 | 0.3355 | 3.4 | 85 | Cu | 15 |
| Example 10 | Kish Graphite | 91.5 | — | 3.4 | 90 | Ag | 10 |
| Example 11 | Kish Graphite | 91.5 | — | 3.4 | 90 | Cu | 10 |
| Example 12 | Natural Graphite | 98.3 | 0.3356 | 2.3 | 60 | Cu | 40 |
| Example 13 | Natural Graphite | 98.3 | 0.3356 | 2.3 | 95 | Cu | 5 |
| Example 14 | Kish Graphite | 91.5 | — | 3.4 | 65 | Al | 35 |
| Comparative Example 1 | Kish Graphite | 91.5 | — | 3.4 | 55 | Al | 45 |

TABLE 1-continued

| No. | Graphite Particles Type | Average Particle Size (μm) | Interplanar Distance (nm) | Average Aspect Ratio | Percentage (vol. %) | Coating Metal Type | Percentage (vol. %) |
|---|---|---|---|---|---|---|---|
| Comparative Example 2 | Artificial Graphite | 6.8 | 0.3375 | 1.6 | 85 | Cu | 15 |
| Comparative Example 3 | Artificial Graphite | 6.8 | 0.3378 | 1.6 | 70 | Ag | 30 |
| Comparative Example 4 | Kish graphite | 91.5 | — | 3.4 | 85 | Cu | 15 |

TABLE 2

| No. | Metal-Coating Method | Solidification Method | Pressure (MPa) | Temperature (° C.) | Time (min.) |
|---|---|---|---|---|---|
| Example 1 | Electroless Plating | Uniaxially Pressing | 500 | Room Temperature | 1 |
| Example 2 | Electroless Plating | Uniaxially Pressing | 1000 | Room Temperature | 1 |
| Example 3 | Electroless Plating | SPS | 60 | 1000 | 10 |
| Example 4 | Electroless Plating | HP | 60 | 900 | 60 |
| Example 5 | Electroless Plating | SPS | 60 | 550 | 10 |
| Example 6 | Mechanical Alloying | HP | 80 | 1000 | 60 |
| Example 7 | Mechanical Alloying | Uniaxially Pressing | 500 | Room Temperature | 1 |
| Example 8 | Mechanical alloying | HIP | 1000 | 500 | 60 |
| Example 9 | Electroless Plating | Uniaxially Pressing | 1000 | Room Temperature | 1 |
| Example 10 | Electroless Plating | Uniaxially Pressing | 500 | Room Temperature | 1 |
| Example 11 | Electroless Plating | Uniaxially Pressing | 1000 | Room Temperature | 1 |
| Example 12 | Electroless Plating | Uniaxially Pressing | 500 | Room Temperature | 1 |
| Example 13 | Electroless Plating | Uniaxially Pressing | 500 | Room Temperature | 1 |
| Example 14 | Mechanical Alloying | Rolling | 1000 | Room Temperature | — |
| Comparative Example 1 | Dry Ball-Milling | Uniaxially Pressing | 500 | Room Temperature | 1 |
| Comparative Example 2 | Electroless Plating | HP | 60 | 900 | 60 |
| Comparative Example 3 | Mechanical Alloying | SPS | 50 | 1000 | 10 |
| Comparative Example 4 | Dry Ball-Milling | Uniaxially Pressing | 500 | Room Temperature | 1 |

TABLE 3

| No. | Heat Treatment Temperature (° C.) | Pressure[1] (MPa) | Atmosphere | Time (hr) | Thermal Conductivity[2] (W/mK) |
|---|---|---|---|---|---|
| Example 1 | — | — | — | — | 180 |
| Example 2 | 600 | 0 | Vacuum | 1 | 280 |
| Example 3 | — | — | — | — | 420 |
| Example 4 | 900 | 0 | Vacuum | 1 | 420 |
| Example 5 | 500 | 0 | Air | 1 | 300 |
| Example 6 | 900 | 0 | Vacuum | 1 | 320 |
| Example 7 | 700 | 0 | Nitrogen | 1 | 300 |

TABLE 3-continued

| No. | Heat Treatment Temperature (° C.) | Pressure[1] (MPa) | Atmosphere | Time (hr) | Thermal Conductivity[2] (W/mK) |
|---|---|---|---|---|---|
| Example 8 | — | — | — | — | 280 |
| Example 9 | 800 | 100 | Argon | 1 | 440 |
| Example 10 | 700 | 100 | Argon | 1 | 460 |
| Example 11 | — | — | — | — | 220 |
| Example 12 | — | — | — | — | 150 |
| Example 13 | — | — | — | — | 250 |
| Example 14 | 500 | 0 | Air | 1 | 200 |
| Comparative Example 1 | — | — | — | — | 120 |
| Comparative Example 2 | — | — | — | — | 100 |
| Comparative Example 3 | — | — | — | — | 120 |
| Comparative Example 4 | — | — | — | — | 80 |

Note:

[1]The atmospheric pressure was regarded as 0 MPa.

[2]Thermal conductivity of composite in a direction perpendicular to the pressing direction.

Examples 15-19, Comparative Example 5

Graphite/copper composites were produced in the same manner as in Example 2 except for changing heat treatment temperatures, and their thermal conductivities in a direction perpendicular to the pressing direction were measured. The relative density and oxygen concentration of the graphite/copper composites were measured. Further, a copper portion in each graphite/copper composite was measured with respect to first and second peak values and the half-width of the first peak in X-ray diffraction, to determine a peak ratio and a peak half-width. The results are shown in Table 4 together with Example 2.

TABLE 4

| No. | Heat Treatment Temperature (° C.) | Graphite/Copper Composite Relative Density (%) | Thermal Conductivity[1] (W/mK) | Oxygen Concentration (ppm) | Copper Portion Peak Ratio[2] (%) | Half-Width[3] (times) |
|---|---|---|---|---|---|---|
| Example 15 | 400 | 95 | 230 | 11600 | 26.6 | 3 |
| Example 16 | 500 | 93.5 | 255 | 6120 | 31.5 | 2.11 |
| Example 2 | 600 | 93 | 280 | 6260 | — | — |
| Example 17 | 700 | 93 | 300 | 6330 | — | — |
| Example 18 | 800 | 92 | 270 | 5570 | — | — |
| Example 19 | 900 | 86 | 250 | 5950 | 37.9 | 1.56 |
| Comparative Example 5 | 1000 | 75 | 130 | — | — | — |

Note:
[1]The thermal conductivity of the composite in a direction perpendicular to the pressing direction.
[2]The peak ratio was determined by (second peak value/first peak value) × 100%.
[3]The half-width (magnification) was determined by (half-width of first peak in each Example)/(half-width of first peak of reference piece).

As is clear from Table 4, the thermal conductivity is the maximum when the heat treatment temperature is 700° C., and then decreases as the heat treatment temperature elevates. It was found that particularly when the heat treatment temperature exceeded 900° C., the thermal conductivity became as insufficient as less than 150 W/mK. The relative density decreased as the heat treatment temperature elevated. This appears to be due to the fact that peeling occurs at the boundary of graphite and copper because of the mismatch of graphite and copper in a thermal expansion coefficient. The oxygen concentration decreased as the heat treatment temperature elevated. When the heat treatment temperature reached 1000° C., the thermal conductivity of the composite became as low as 130 W/mK (Comparative Example 5).

The peak ratio of copper shows the orientation of copper crystals. Peak ratio data indicate that as the heat treatment temperature elevates, the crystallinity of copper crystals improves. The half-width shows the degree of crystallization of copper. It is clear that as the heat treatment temperature elevates, the degree of crystallization of copper becomes higher.

Examples 20 and 21, and Comparative Examples 6-8

Figure 4:
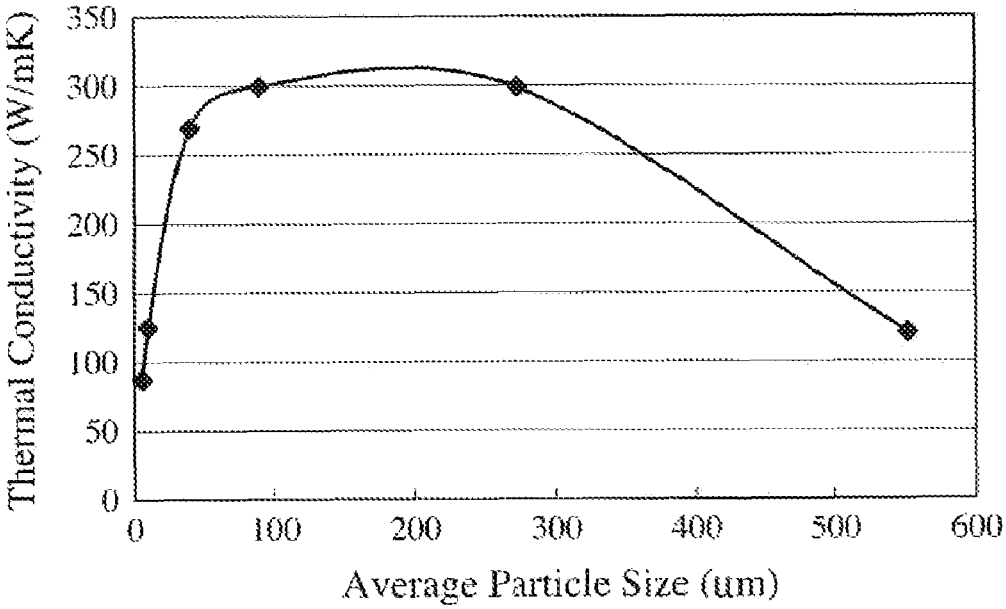
FIG. 4 is a graph showing the relation between the average particle size of the graphite particles and the thermal conductivity of the composite.
Figure 5A:
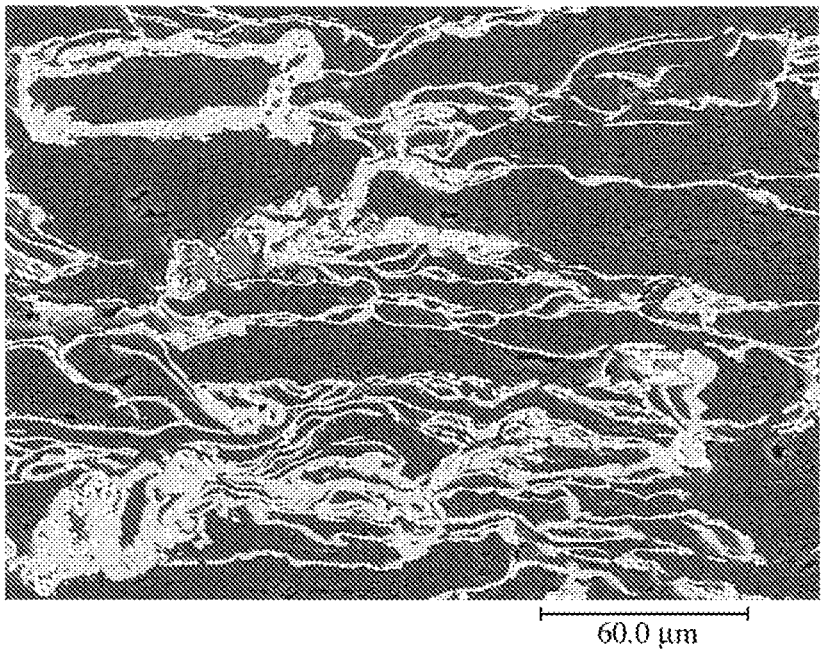
FIG. 5(*a*) is an electron photomicrograph (magnification: 500 times) showing the cross section structure in the pressing direction of the composite heat-treated at 700° C. in Example 22.
Figure 5B:
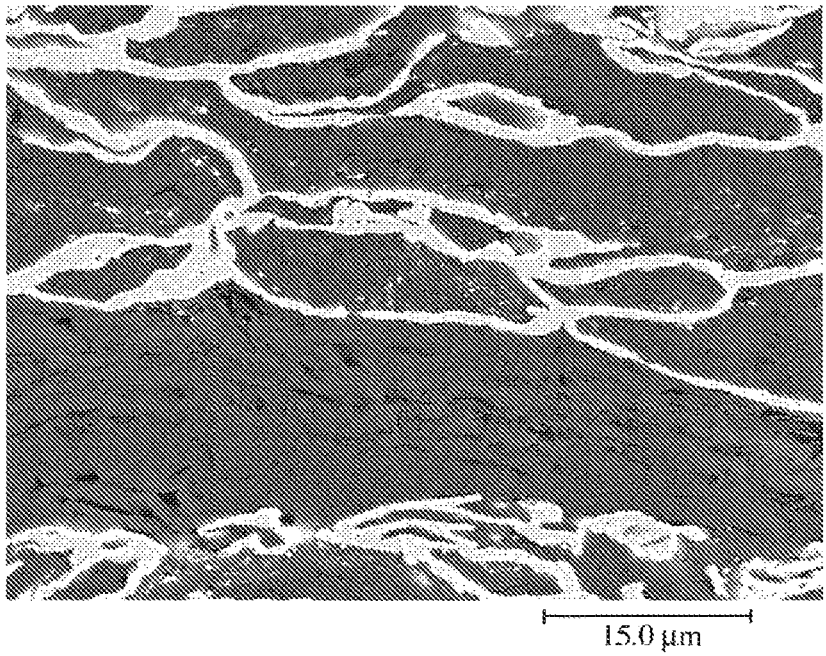
Figure 5C:
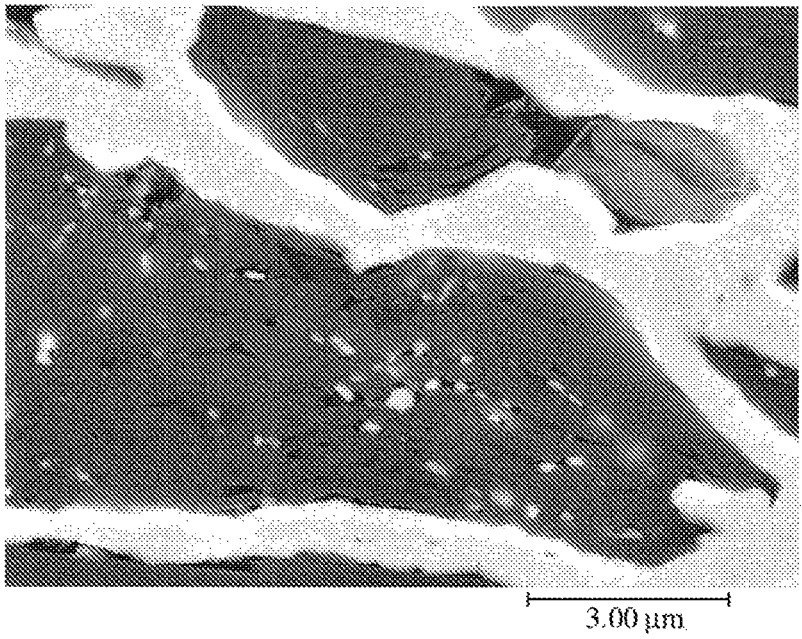
Figure 5D:
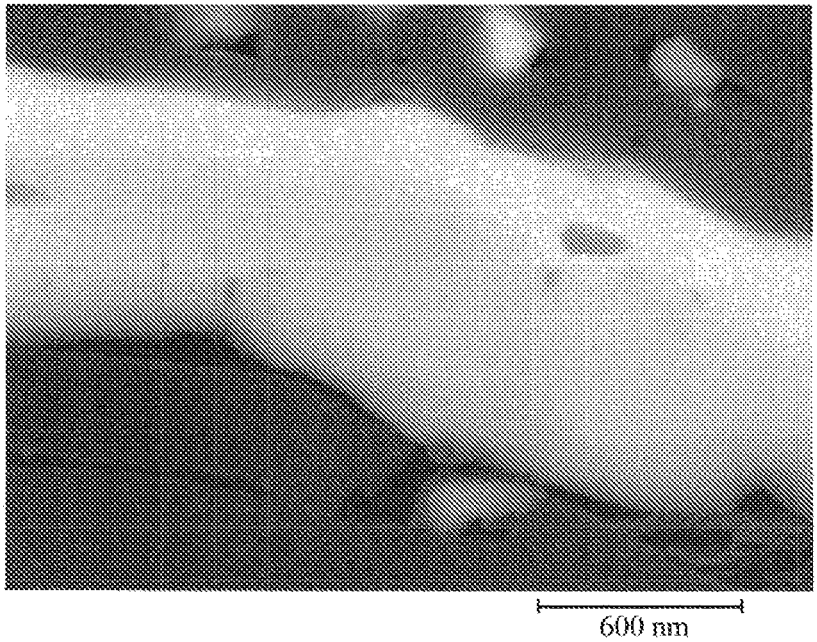

Graphite/copper composites were produced in the same manner as in Example 17 except for using graphite particles having different average particle sizes and average aspect ratios, and their thermal conductivity and relative density were measured in a direction perpendicular to the pressing direction. For comparison, a graphite/copper composite (Comparative Example 8) produced in the same manner as in Example 17 except for using artificial graphite particles having an average particle size of 6.8 μm was also measured with respect to thermal conductivity and relative density in a direction perpendicular to the pressing direction. The results are shown in Table 5 together with Example 17. The relation between the average particle size of the graphite particles and the thermal conductivity of the composite is shown in FIG. 4.

TABLE 5

| No. | Graphite Particles Type | Average Particle Size (μm) | Average Length of Long Axis (μm) | Average Aspect Ratio | Graphite/Copper Composite Thermal Conductivity[1] (W/mK) | Relative Density (%) |
|---|---|---|---|---|---|---|
| Comparative Example 6 | Kish graphite | 553.3 | 570.2 | 3.8 | 120 | 73 |
| Example 20 | Kish graphite | 274.5 | 298.2 | 3.2 | 298 | 94 |
| Example 17 | Kish graphite | 91.5 | 105.3 | 3.4 | 300 | 93 |
| Example 21 | Kish graphite | 41.2 | 53.2 | 2.6 | 270 | 93 |
| Comparative Example 7 | Kish graphite | 11.2 | 15.4 | 2.8 | 125 | 93 |
| Comparative Example 8 | Artificial Graphite | 6.8 | 10.2 | 1.6 | 87 | 91 |

Note:
[1]The thermal conductivity of the composite in a direction perpendicular to the pressing direction.

As is clear from Table 5 and FIG. 4, when the graphite particles have as small an average particle size as 11.2 μm, their thermal conductivity is as low as 125 W/mK (Comparative Example 7). This appears to be due to the fact that as the average particle size of the graphite particles becomes smaller, more boundaries exist between the high-thermal-conductivity graphite particles and copper, resulting in increased thermal resistance at the boundaries. On the other hand, when the average particle size is as too large as 553.3 μm, the thermal conductivity rather decreases to 120 W/mK (Comparative Example 6). This appears to be due to the fact that when the average particle size of the composite becomes too large, its relative density becomes too low. With the artificial graphite of Comparative Example 8 having an average particle size as small as 6.8 μm, a composite having extremely low thermal conductivity of 87 W/mK was produced even by the same method as in Example 17.

The relative density of the composite is correlated with the average particle size of the graphite particles. In Comparative Example 6 using graphite particles having an average particle size as large as 553.3 μm, the resultant composite had as low a relative density as 73%. This appears to be due to the fact that because of limited deformability of graphite particles, gaps between coarse graphite particles are not fully filled.

Example 22

Figure 6:
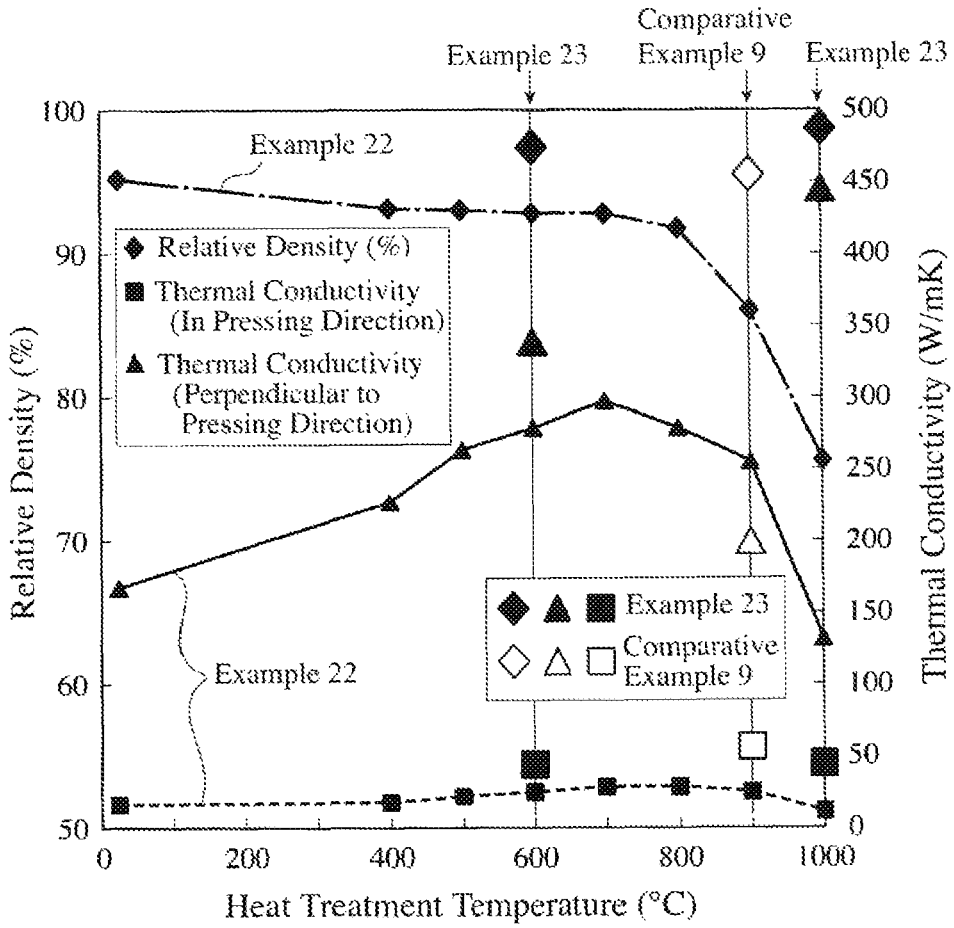
FIG. 6 is a graph showing the relation between a heat treatment temperature and the thermal conductivity and relative density of the composite.

88% by volume of Kish graphite having an average particle size of 91.5 μm, a (002) interplanar distance of 0.3355 and an average aspect ratio of 3.4 was electroless-plated with 12% by volume of copper. The resultant copper-coated graphite particles were uniaxially pressed at 1000 MPa and room temperature for 1 minute, to obtain a graphite/copper composite. This graphite/copper composite was heat-treated at each temperature up to 1000° C. for 1 hour in vacuum at atmospheric pressure. The cross section structure in a pressing direction of the composite obtained at a heat treatment temperature of 700° C. is shown in FIG. 5(*a*) (magnification: 500 times) to FIG. 5(*d*) (magnification: 50,000 times). The thermal conductivity and relative density of the heat-treated composite were also measured. The relation between the heat treatment temperature and the thermal conductivity and relative density of the composite is shown in FIG. 6.

Example 23

The same copper-coated graphite particles as in Example 22 were sintered at 60 MPa and at 600° C. and 1000° C., respectively, for 10 minutes by an SPS method, to obtain graphite/copper composites. The thermal conductivity and relative density of each graphite/copper composite were measured. The relation between the sintering temperature and the thermal conductivity and relative density of the composite is shown in FIG. 6.

Comparative Example 9

50% by volume of Kish graphite having an average particle size of 91.5 μm, a (002) interplanar distance of 0.3355 and an average aspect ratio of 3.4 was dry-mixed with 50% by volume of copper powder having an average particle size of 10 μm by a ball mill. The resultant mixed powder was sintered at 60 MPa and 900° C. for 0.5 hours by an SPS method. The thermal conductivity and relative density of the resultant graphite/copper composite were measured. The relation between the sintering temperature and the thermal conductivity and relative density of the composite is shown in FIG. 6.

As is clear from FIG. 6, the graphite/copper composite of Example 22 subjected to a heat treatment after uniaxial pressing had a peak thermal conductivity (in a direction perpendicular to the pressing direction) at a heat treatment temperature of 700° C., and its relative density drastically decreased when the heat treatment temperature exceeded 800° C. This indicates that the heat treatment temperature should be 300° C. or higher, and is preferably 300-900° C., more preferably 500-800° C. Incidentally, the thermal conductivity in the pressing direction was low, without depending on the heat treatment temperature. In the case of the graphite/copper composite of Example 23 produced by the SPS method, both of its thermal conductivity and relative density became larger, as the sintering temperature elevated. On the other hand, the graphite/copper composite of Comparative Example 9 produced from powder dry-mixed by a ball mill had small anisotropy in thermal conductivity, and low thermal conductivity in a direction perpendicular to the pressing direction.

EFFECT OF THE INVENTION

Because the graphite-particles-dispersed composite of the present invention are produced by forming a high-thermal-conductivity metal coating on graphite particles having as large an average particle size as 20-500 μm, and then pressing them in at least one direction, it has as high thermal conductivity as 150 W/mK or more in at least one direction. It also has high relative density by pressing. The graphite-particles-dispersed composite of the present invention having such features is suitable for heat sinks, heat spreaders, etc.

What is claimed is:

1. A graphite-particles-dispersed composite produced by compacting graphite particles coated with a high-thermal-conductivity metal, wherein said graphite particles have an average particle size of 20-500 μm and an average aspect ratio of 2 or more, wherein the volume ratio of said graphite particles to said metal is 60/40-95/5, wherein said composite has a structure that said metal-coated graphite particles are pressed in one direction so that said graphite particles and said metal are laminated in the pressing direction, and wherein thermal conductivity of said composite in a direction perpendicular to the pressing direction is more than that in the pressing direction, and is 150 W/mK or more.

2. The graphite-particles-dispersed composite according to claim 1, wherein said graphite particles have a (002) interplanar distance of 0.335-0.337 nm.

3. The graphite-particles-dispersed composite according to claim 1, wherein said graphite particles are at least one selected from the group consisting of pyrolytic graphite, Kish graphite and natural graphite.

4. The graphite-particles-dispersed composite according to claim 1, wherein said metal is at least one selected from the group consisting of silver, copper and aluminum.

5. The graphite-particles-dispersed composite according to claim 1, wherein said graphite particles have an average particle size of 40-400 μm.

6. The graphite-particles-dispersed composite according to claim 1, which has a relative density of 80% or more.

7. A method for producing a graphite-particles-dispersed composite having a structure that graphite particles and metal are laminated in a pressing direction, and a thermal conductivity in a direction perpendicular to the pressing direction that is more than that in the pressing direction and of 150 W/mK or more, comprising the steps of coating 60-95% by volume of graphite particles having an average particle size of 20-500 μm and an average aspect ratio of 2 or more with 40-5% by volume of a high-thermal-conductivity metal, and pressing the resultant metal-coated graphite particles at a temperature lower than melting point of said metal in one direction for compaction.

8. The method for producing a graphite-particles-dispersed composite according to claim 7, wherein at least one selected from the group consisting of pyrolytic graphite particles, Kish graphite particles and natural graphite particles are used as said graphite particles.

9. The method for producing a graphite-particles-dispersed composite according to claim 7, wherein said metal is at least one selected from the group consisting of silver, copper and aluminum.

10. The method for producing a graphite-particles-dispersed composite according to claim 7, wherein said metal-coated graphite particles are compacted by at least one of a uniaxial pressing method, a rolling method, a hot-pressing method, and a pulsed-current pressure sintering method.

11. The method for producing a graphite-particles-dispersed composite according to claim 10, wherein said metal-coated graphite particles are uniaxially pressed, and then heat-treated at a temperature of 300° C. or higher and lower than the melting point of said metal.

12. The method for producing a graphite-particles-dispersed composite according to claim 11, wherein the heat treatment temperature is 300-900° C.

13. The method for producing a graphite-particles-dispersed composite according to claim 11, wherein the pressing is conducted at a pressure of 20-200 MPa during said heat treatment.

14. The method for producing a graphite-particles-dispersed composite according to claim 7, wherein said graphite particles are coated with said metal by an electroless plating method or a mechanical alloying method.

15. A method for producing a graphite-particles-dispersed composite having thermal conductivity of 150 W/mK or more in a direction perpendicular to a pressing direction, comprising the steps of electroless-plating 60-95% by volume of graphite particles, which are at least one selected from the group consisting of pyrolytic graphite, Kish graphite and natural graphite and have an average particle size of 20-500 μm, with 40-5% by volume of copper; pressing the resultant copper-plated graphite particles in said pressing direction at room temperature; and then heat-treating it at 300-900° C.

16. The method for producing a graphite-particles-dispersed composite according to claim 15, wherein said graphite particles have an average aspect ratio of 2 or more.

17. The method for producing a graphite-particles-dispersed composite according to claim 15, wherein the pressing is conducted at a pressure of 20-200 MPa during said heat treatment.

* * * * *